US012408698B1

(12) United States Patent
Wang

(10) Patent No.: US 12,408,698 B1
(45) Date of Patent: Sep. 9, 2025

(54) CONTAINER ASSEMBLY

(71) Applicant: Charlie Wang, Chino Hills, CA (US)

(72) Inventor: Charlie Wang, Chino Hills, CA (US)

( * ) Notice: Subject to any disclaimer, the term of this patent is extended or adjusted under 35 U.S.C. 154(b) by 594 days.

(21) Appl. No.: 17/746,876

(22) Filed: May 17, 2022

Related U.S. Application Data

(63) Continuation-in-part of application No. 17/378,326, filed on Jul. 16, 2021, now Pat. No. 11,896,050.

(60) Provisional application No. 63/190,568, filed on May 19, 2021, provisional application No. 63/084,118, filed on Sep. 28, 2020.

(51) Int. Cl.

| | |
|---|---|
| ***A24F 1/30*** | (2006.01) |
| ***A24F 5/00*** | (2006.01) |
| ***A24F 7/00*** | (2006.01) |
| ***A24F 7/02*** | (2006.01) |

(52) U.S. Cl.
CPC ..... *A24F 1/30* (2013.01); *A24F 5/00* (2013.01); *A24F 7/02* (2013.01)

(58) Field of Classification Search
None
See application file for complete search history.

(56) References Cited

U.S. PATENT DOCUMENTS 5,478,586 A * 12/1995 Connor ..... A47J 31/20 426/433
7,404,405 B1 * 7/2008 Mehio ..... A24F 1/30 131/191
D622,502 S * 8/2010 Badawi ..... D3/276
11,896,050 B2 * 2/2024 Wang ..... A24F 1/30
2019/0230981 A1 * 8/2019 Isler ..... A24F 1/02

FOREIGN PATENT DOCUMENTS

EP 3808193 A1 * 4/2021 ..... A24F 1/30

OTHER PUBLICATIONS

Definition of percolate, Dictionary.com, [online], retrieved from the Internet, [retrieved Nov. 2, 2024], URL:https://www.dictionary.com/browse/percolate (Year: 2024).*

* cited by examiner

*Primary Examiner* — Dennis R Cordray
(74) *Attorney, Agent, or Firm* — Adibi IP Group, PC; Amir V. Adibi; Andrew C. Palmer

(57) ABSTRACT

A container assembly and method is provided for concealing and storing a water pipe. The container assembly, for example, is generally a cylindrical container comprising an upper container, a middle container, a middle container lid, a lower container, a percolator, an inlet port, a neck, and a bowl. The neck and the bowl are configured to be stored in the lower container. The upper container is configured to contain a grinder. The upper container and lower container are detachably attached to the middle container. The container assembly and method also involves sliding the percolator to and from an extracted position that permits a user to inhale combustible substances, to a concealed position within the middle container.

18 Claims, 17 Drawing Sheets

PERSPECTIVE VIEW OF ANOTHER EMBODIMENT

PERSPECTIVE VIEW OF CONTAINER ASSEMBLY

PERSPECTIVE VIEW OF UPPER CONTAINER LID AND PERCOLATOR

PERSPECTIVE VIEW OF UPPER CONTAINER LID AND PERCOLATOR

PERSPECTIVE VIEW OF PERCOLATOR

PERSPECTIVE VIEW OF PERCOLATOR

PERSPECTIVE VIEW OF LOWER CONTAINER

PERSPECTIVE VIEW OF CONTAINER ASSEMBLY

PERSPECTIVE VIEW OF ANOTHER EMBODIMENT

PERSPECTIVE VIEW OF THE GRINDER

PERSPECTIVE VIEW OF THE GRINDER

PERSPECTIVE VIEW OF THE PERCOLATOR

PERSPECTIVE VIEW OF THE CONTAINER ASSEMBLY

CONTAINER ASSEMBLY

CROSS REFERENCE TO RELATED APPLICATIONS

This application is a continuation-in-part that claims the benefit under 35 U.S.C. § 120 from U.S. nonprovisional patent application Ser. No. 17/378,326, entitled "Container Assembly," filed on Jul. 16, 2021. U.S. patent application Ser. No. 17/378,326 claims the benefit under 35 U.S.C. § 119 from U.S. provisional patent application Ser. No. 63/084,118, entitled "Container Assembly," filed on Sep. 28, 2020. This application also claims the benefit under 35 U.S.C. § 119 from U.S. provisional patent application Ser. No. 63/190,568, entitled "Container Assembly," filed on May 19, 2021. The subject matter of each of the foregoing documents is expressly incorporated herein by reference.

TECHNICAL FIELD

The present invention relates generally to an apparatus to store a smoking water pipe/bong and water pipe accessories such as a grinder; and more specifically, to a container assembly having a disguised appearance that permits a smoker to inhale combustible substances such as tobacco and medicinal herbs.

BACKGROUND INFORMATION

The use of water in a smoking apparatus is ancient, dating back at least several hundred years. An illustrative example of early smoking water pipes is Persian hookahs, wherein smoke from the substance being combusted is directed through a tube discharging below the surface of water in a chamber before passing therefrom through a second tube to the mouth of the user. More recently, various modern versions of the water pipes have been manufactured, sold, and used. These versions have not differed in the basic respect from the original hookah, comprising principally a chamber for holding the water, a bowl for the combustible substance communicating by a hollow tube to a point beneath the water, and an outlet tube from a smoke chamber formed above the surface of the water to the mouth of the user. These modern versions of the hookah have been produced in forms not adaptable to being carried by the user in a more compact, smaller, and portable version. Furthermore, the size and shape of these modern versions lack a disguised appearance and draws attention to the user when traveling with a water pipe in public. Since many users prefer to not draw attention to themselves, a desire exists for a container to disguise and store a smoking water pipe/bong and water pipe accessories, such as a grinder, in a portable container assembly.

SUMMARY

Prior to embodiments of the disclosed invention, there was no way to contain a water pipe and water pipe accessories in a discrete container assembly. Embodiments of the disclosed invention solve this problem and overcome the deficiencies of the prior art.

According to one embodiment, a container assembly is configured to store a water pipe. The container assembly comprises: an upper container, the upper container further comprising an inner cylinder wall, an outer cylinder wall, an upper edge, a lower edge, an upper container rim arranged at the upper edge of the upper container, and an inlet port, wherein the inlet port extends through the outer cylinder wall and inner cylinder wall and into the upper container; an upper container lid, wherein the upper container lid is detachably coupled to the upper edge of the upper container; a lower container, wherein the lower container is detachably coupled to the lower edge of the upper container; a percolator, the percolator further comprising a gasket and a mouthpiece; a neck, wherein the neck is detachably coupled to the inlet port and in fluid communication with the percolator through the inlet port, wherein the neck is configured to be stored in the lower container; and a bowl, wherein the bowl is detachably coupled to the neck and in fluid communication with the neck and the percolator, wherein the bowl is configured to be stored in the lower container.

The present invention provides a compact and portable container assembly to conceal a water pipe and water pipe accessories that can be quickly assembled and disassembled.

According to another embodiment, a method for concealing a water pipe and water pipe accessories in a container assembly comprises: attaching an upper container lid to a mouthpiece arranged at an upper portion of a percolator, applying pressure to the upper container lid to slide the percolator from an extracted position to a concealed position, wherein the percolator is concealed within the upper container, attaching the upper container lid to the upper edge of the upper container, removing a lower container from the upper container, disconnecting a bowl from a neck, placing the bowl in the lower container, disconnecting the neck from an inlet port of the upper container, placing the neck in the lower container, and attaching the lower container to a lower edge of the upper container.

For various example embodiments, the following is applicable: an apparatus comprising means for performing a method of any of the claims.

Aspects of the present invention relate to an apparatus or device for a container assembly configured to store a water pipe or bong and various accessories for using the water pipe or bong and methods of using the container assembly.

These and other systems, methods, objects, features, and advantages of the present invention will be apparent to those skilled in the art from the following detailed description of the preferred embodiment and the drawings. All documents mentioned herein are hereby incorporated in their entirety by reference.

The foregoing, and other features and advantages of the invention, will be apparent from the following, more particularized description of the preferred embodiments of the invention, the accompanying drawings, and the claims.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

In various embodiments, a container assembly is disclosed having an innovative approach to conceal a water pipe or bong and its accessories, such as a grinder. The container assembly has a general cylindrical shape to disguise a water pipe or bong. The container assembly can be designed from a variety of materials to include steel, aluminum, copper, titanium, or plastic. The upper container and lower container can be colored the same or have different colors. The container assembly allows for quick concealment of the water pipe or bong when a user wishes to not draw attention to themselves. The components of the water pipe concealed within the container assembly can also be easily disassembled to allow for cleaning of the components of the water pipe.

Figure 1:
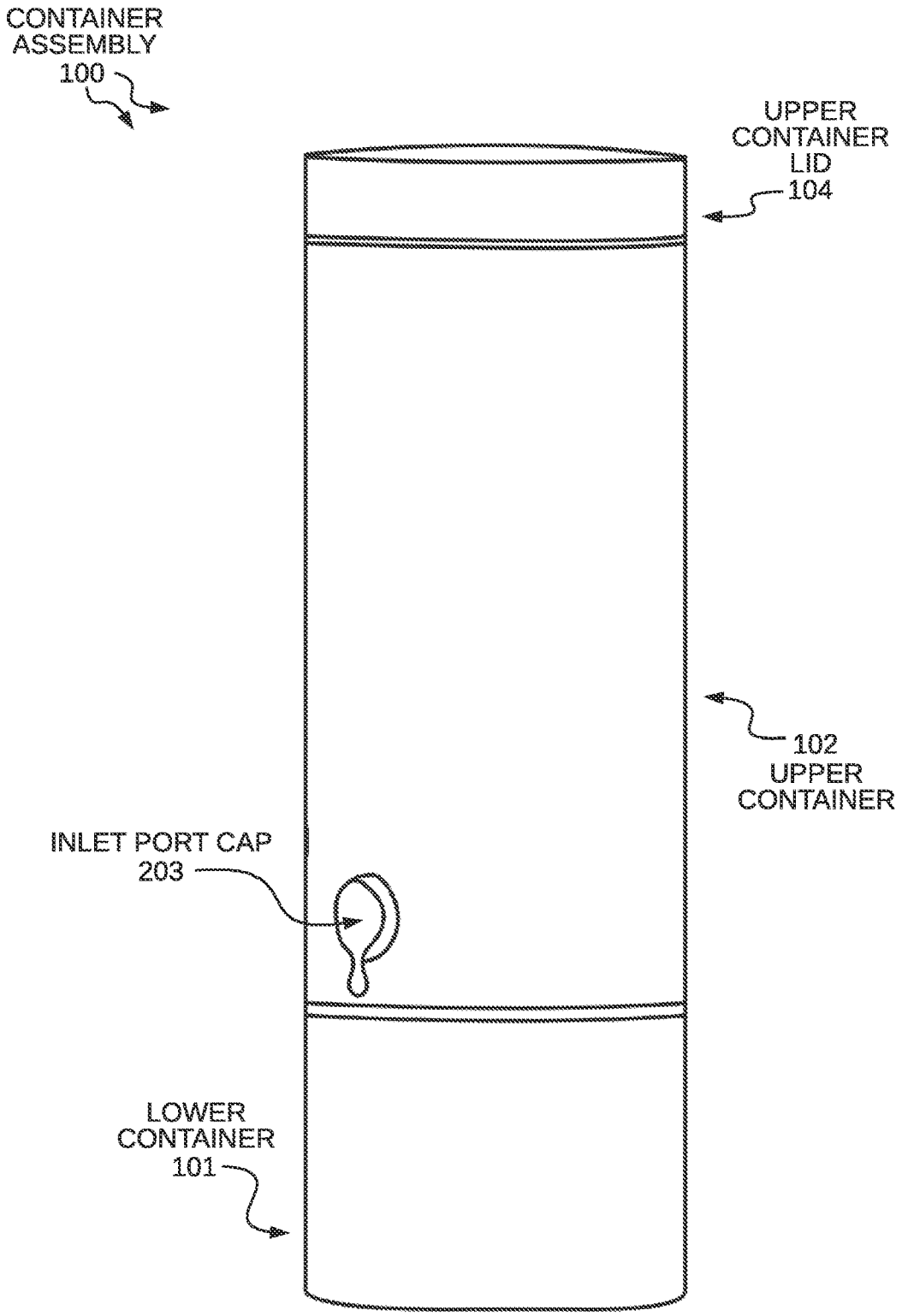
FIG. 1 shows a container assembly configured to store a water pipe according to one embodiment of the invention.

FIG. 1 shows a perspective view of a container assembly 100 in accordance with one embodiment. The container assembly 100 is comprised of an inner cylinder wall 105, an outer cylinder wall 106, an upper container 102, an upper container lid 104, an inlet port 103 (displayed with an inlet port cap 203 attached to the inlet port), and a lower container 101, wherein the upper container 102 and the lower container 101 are detachably coupled to each other and capable of being segregated from each other. By way of example, one embodiment of the container assembly 100 is configured to store a water pipe or bong and permits the user to quickly assemble or disassemble the water pipe concealed within the upper container 102 and the lower container 101. An upper container rim is arranged at an upper edge 107 of the upper container 102. A lower container 101 is detachably coupled to a lower edge of the upper container 102.

The material of container assembly 100 is one selected from a group including but not limited to: steel, aluminum, copper, titanium, plastic, or a combination thereof. The preferred material is aluminum because it is the most cost-efficient, is easy to clean, and offers protection to the components of the water pipe and water pipe accessories.

Figure 2:
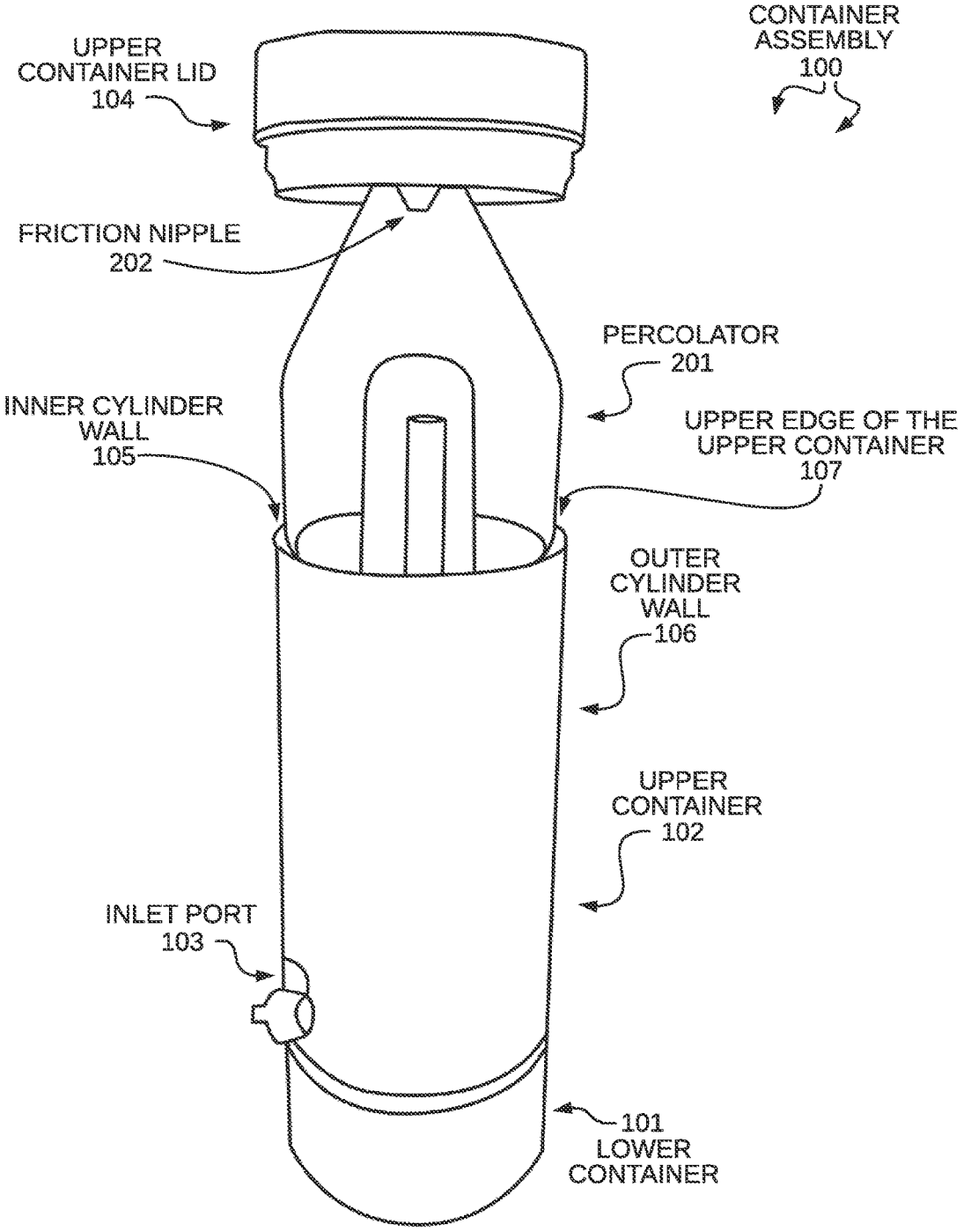
FIG. 2 shows an upper container lid and a percolator of the container assembly 100.
Figure 3:
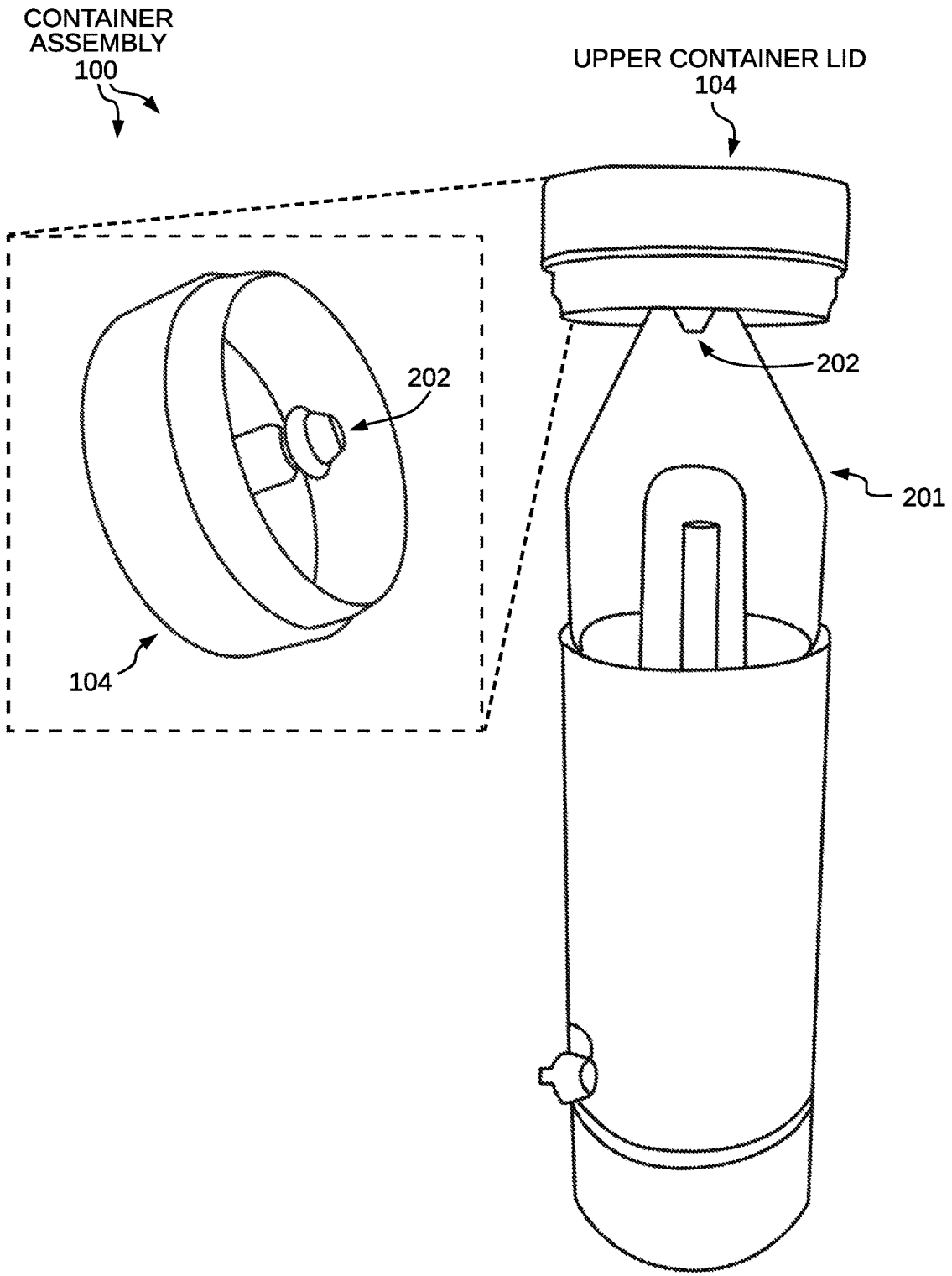
FIG. 3 shows the upper container lid and percolator of the container assembly 100.

FIGS. 2 and 3 show a perspective view of the upper container lid 104 and percolator 201. The upper container lid 104 is detachably coupled to the upper edge 107 of the upper container 102 when the percolator 201 is completely inserted into the upper container. This position permits the percolator 201 to be concealed within the upper container 102. In another embodiment, the upper container lid 104 comprises a friction nipple 202 that when inserted into the percolator 201 (as displayed in FIG. 2), allows the percolator 201 to be extracted from its concealed position within the upper container 102. Once the percolator 201 is fully extracted (as displayed in FIG. 2), the percolator 201 is in a position that permits a smoker to inhale combustible substances, such as tobacco and medicinal herbs, through the percolator 201.

Figure 4:
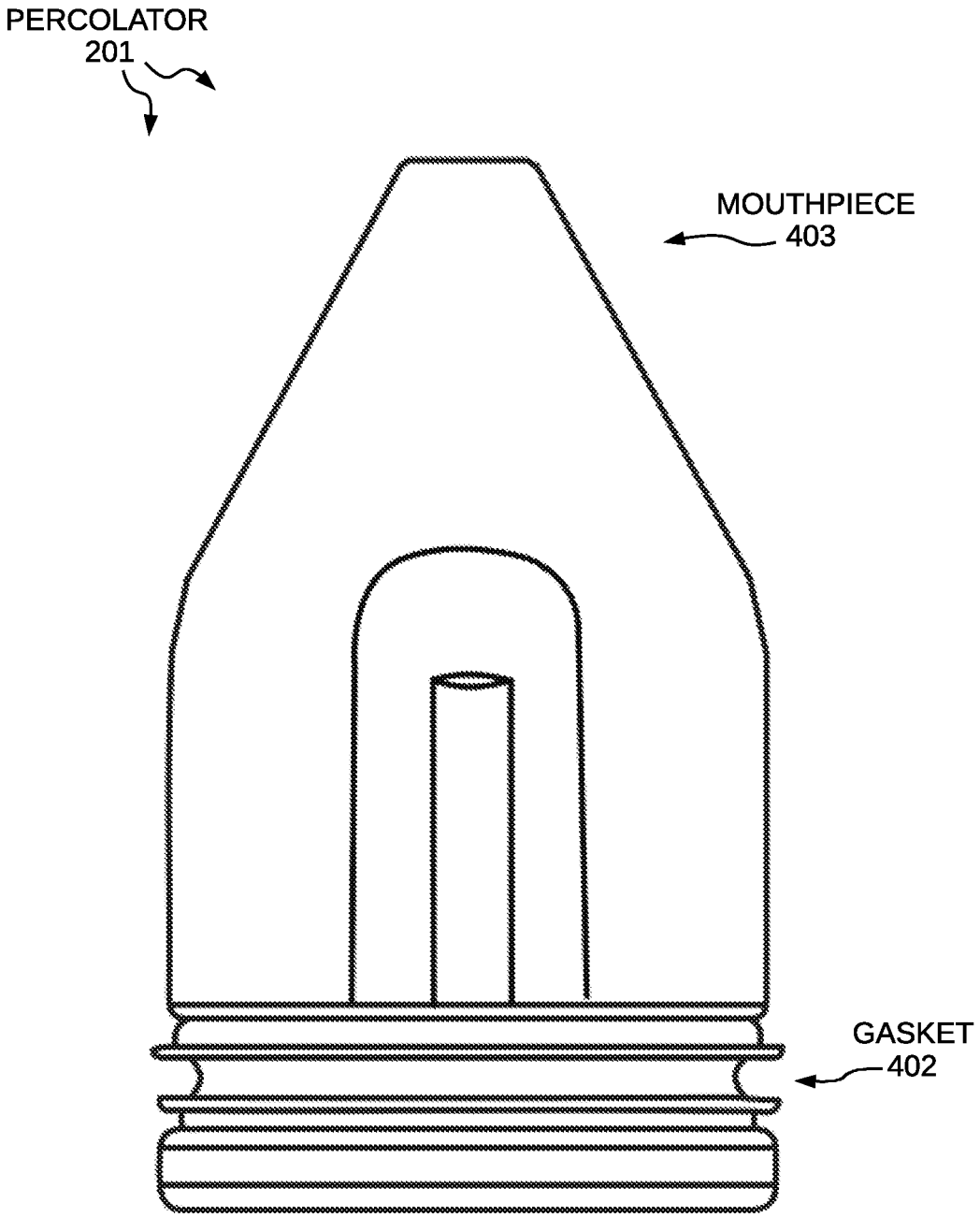
FIG. 4 shows the percolator of the container assembly 100.
Figure 5:
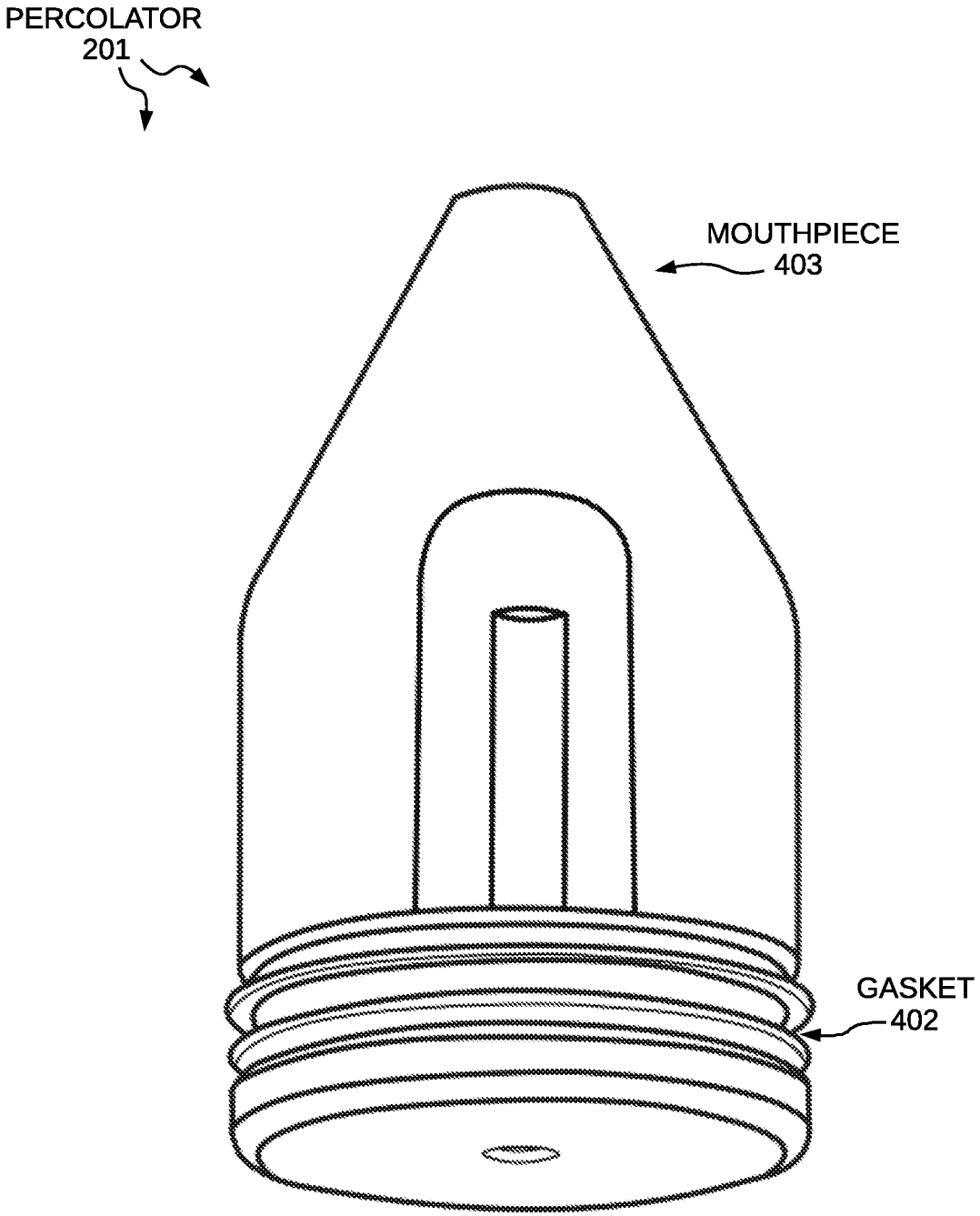
FIG. 5 shows the percolator of the container assembly 100.

FIGS. 4 and 5 show a perspective view of the percolator 201. In a one embodiment, the percolator 201 includes a gasket 402 and a mouthpiece 403. The mouthpiece 403 is arranged at an upper portion of the percolator 201. The percolator 201 is arranged within the upper container 102 and slides along the inner cylinder wall 105 to the upper edge 107 of the upper container 102. To extract the percolator 201 and the mouthpiece 403, the upper container lid 104 is detached from the upper container 102 and the inlet port cap 203 is detached from the inlet port 103, and with the friction nipple 202 fully inserted into the mouthpiece 403, the upper container lid 104 is pulled upward in a vertical motion from the upper container 102 to extract the percolator 201 from a concealed position within the upper container 102. When the percolator 201 is pulled from the concealed position inside of the upper container 102 to an extracted position, the gasket 402 is pressed against the upper container rim to form a watertight seal. The percolator 201 is one selected from a group including but not limited to: dome, inline, circular, showerhead, honeycomb, tree, matrix, swiss, donut, turbine, or a combination thereof. The preferred percolator 201 is a dome percolator.

Figure 6:
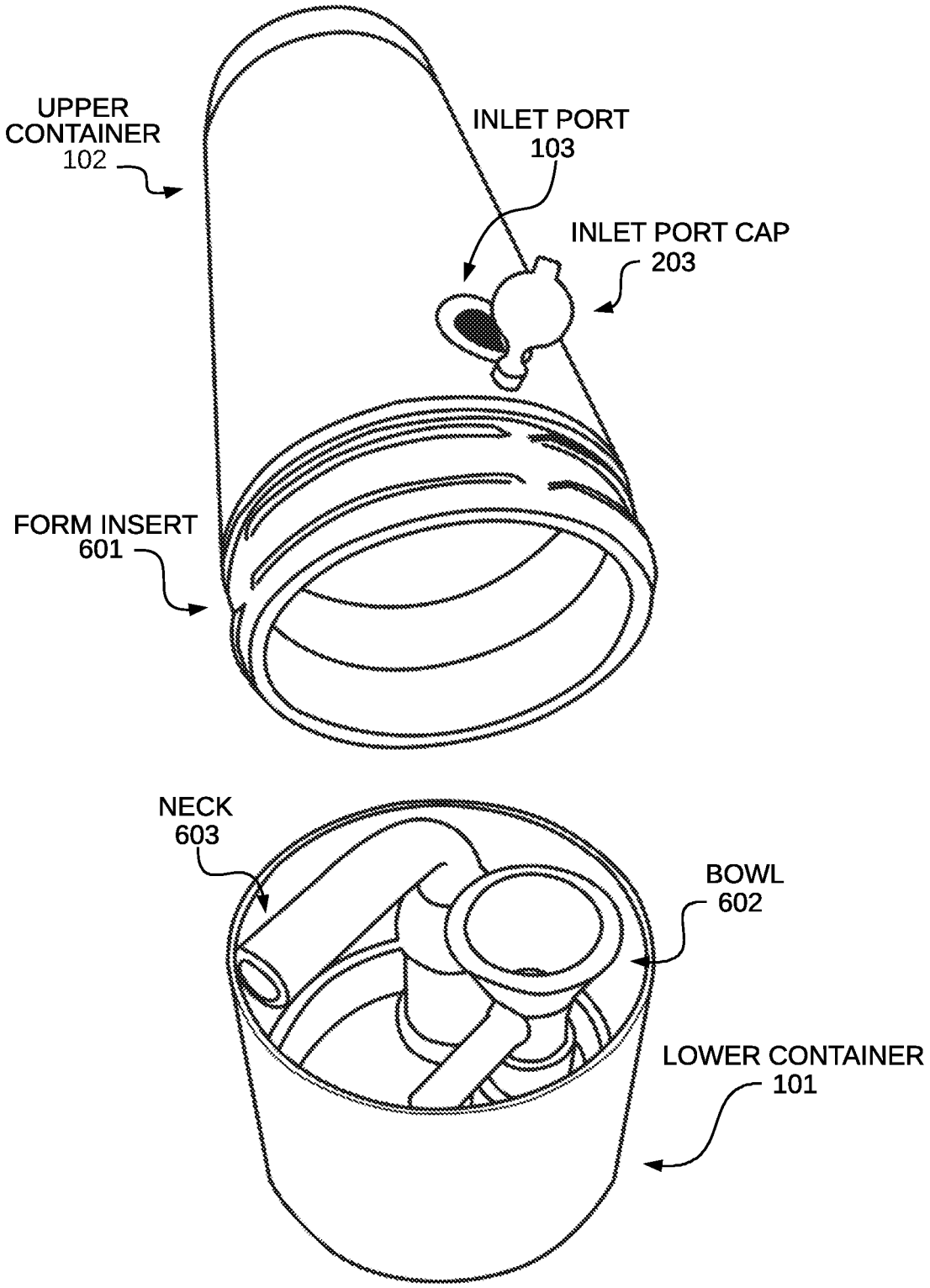
FIG. 6 shows a lower container of the container assembly 100.
Figure 7:
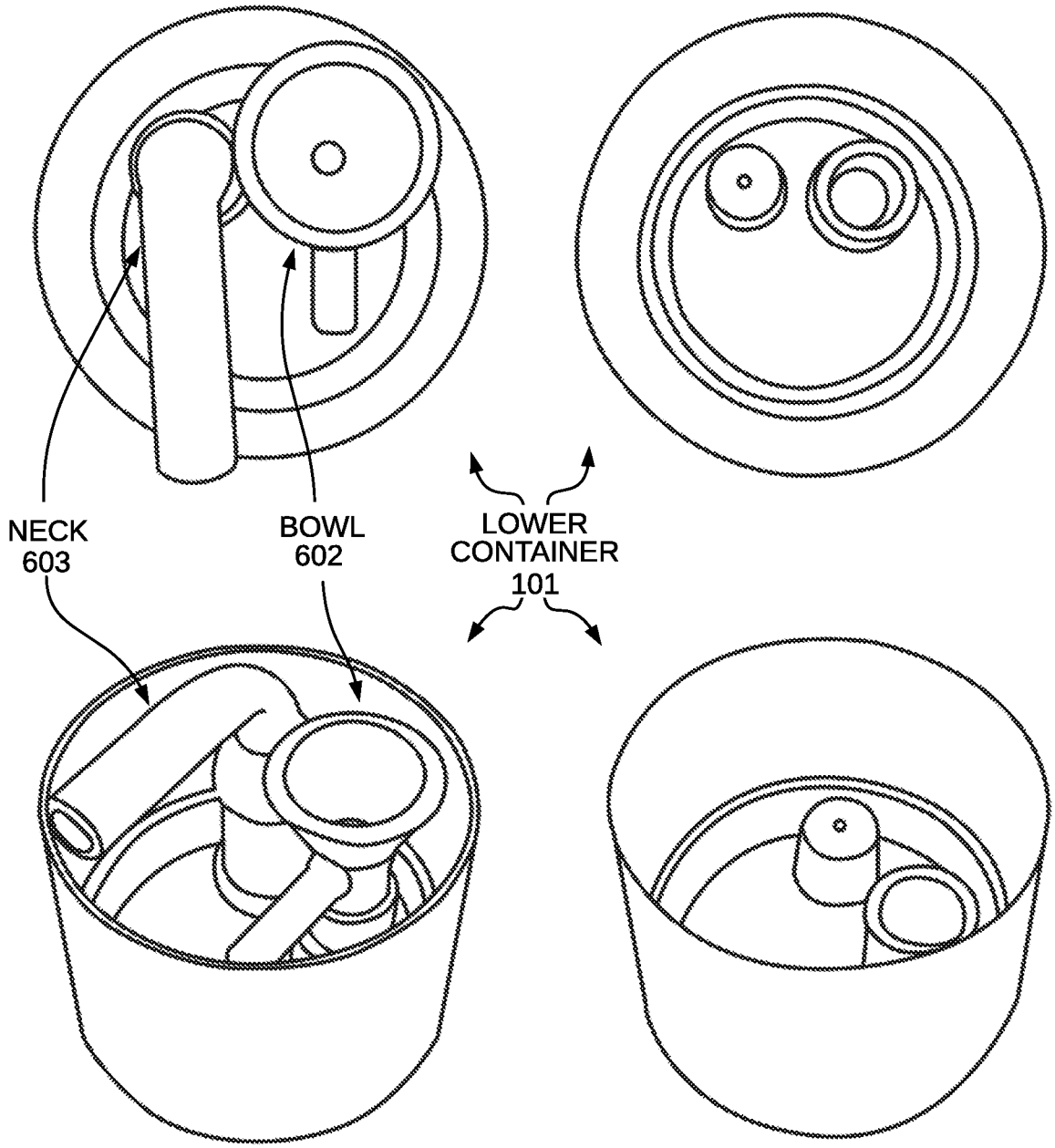
FIG. 7 shows the lower container of the container assembly 100.

FIGS. 6 and 7 show a perspective view of the lower container 101. In one embodiment, the lower container 101 comprises a form insert 601 that fits the shape of the upper container 102 and the lower container 101. The form insert 601 is detachably coupled to the lower edge of the upper container 102 and the lower container 101 is detachably coupled to the form insert. In another embodiment, a neck 603 and a bowl 602 can be attached to the form insert 601 to prevent the neck 603 and the bowl 602 from cracking, chipping, or breaking while stored inside the lower container 101.

Figure 8:
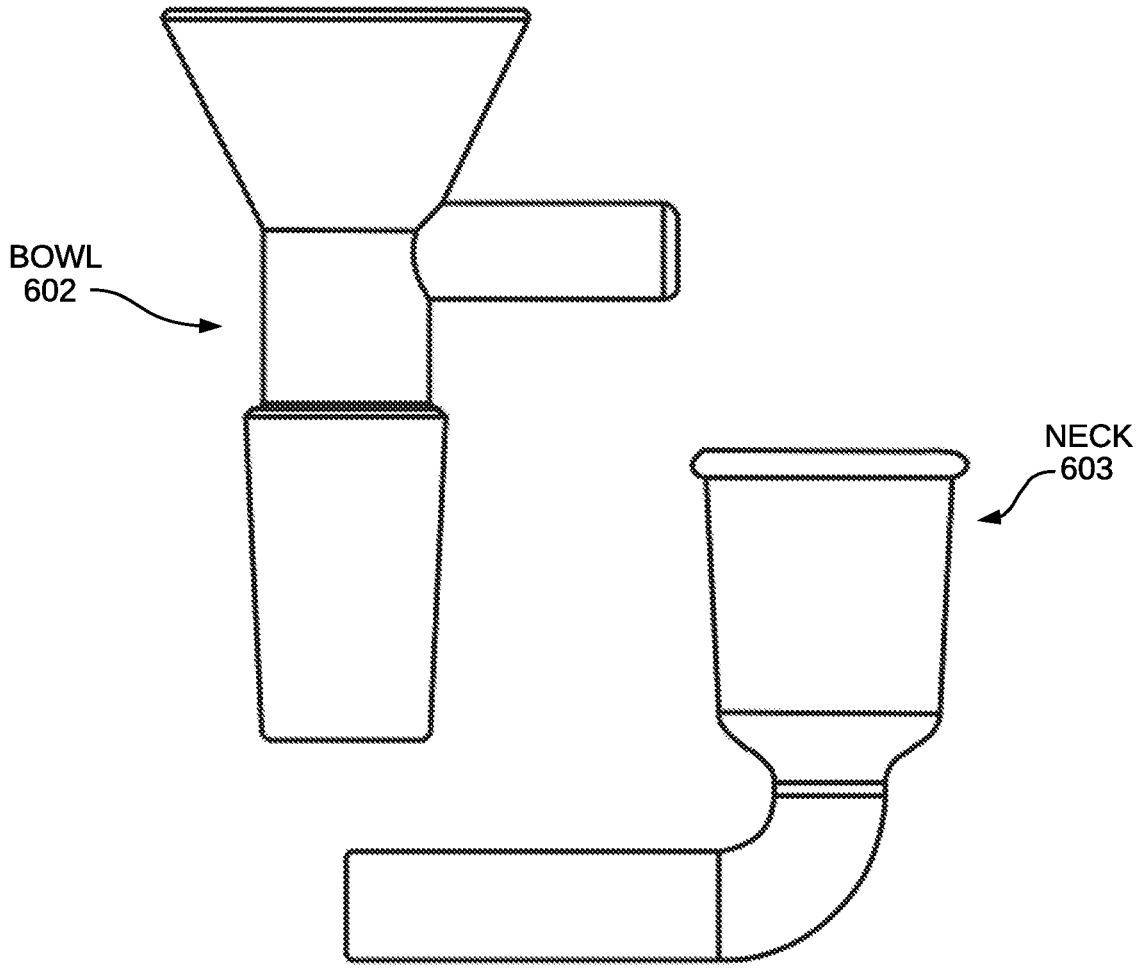
FIG. 8 shows a neck and bowl of the container assembly 100.

FIG. 8 shows a perspective view of the neck 603 and the bowl 602. The neck 603 is in fluid communication with the percolator 201 when a user connects the neck 603 to an inlet port 103 extending through the outer cylinder wall and inner cylinder wall and into the upper container 102. The inlet port 103 includes an inlet port cap 203 to protect the inlet port 103 and prevent the inside of the upper container 102 from getting contaminated. The neck 603 may be configured to be stored in the lower container 101. When the lower container 101 is detached from the upper container 102, a user may then access the lower container 101 to remove the neck 603. The bowl 602, when attached to the neck 603, is in fluid communication with the neck 603 and the percolator 201.

The bowl 602 may be configured to be stored in the lower container 101. The neck 603 and bowl 602 are designed from a variety of materials. The preferred material of the neck 603 and bowl 602 is glass.

Figure 9:
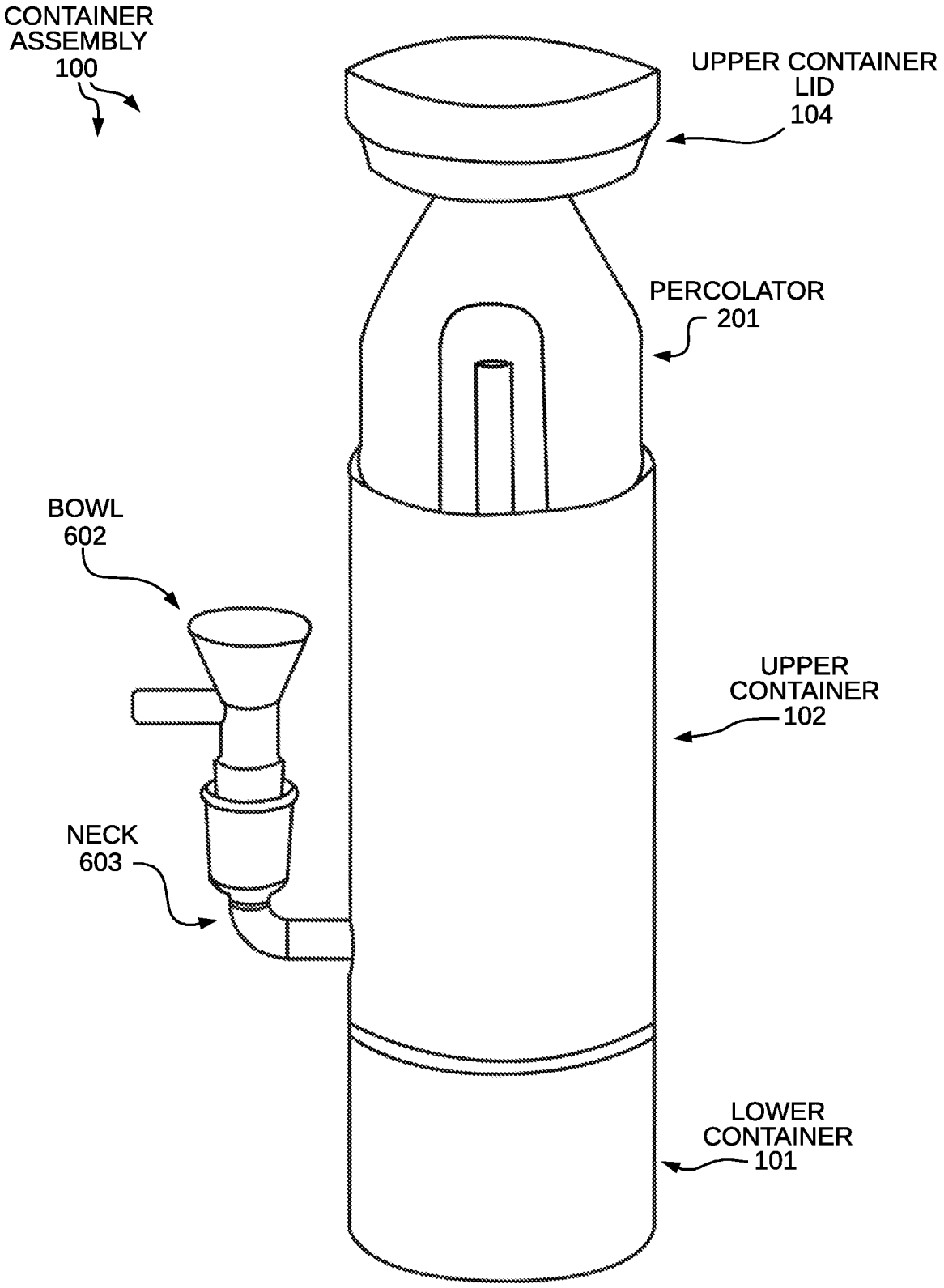
FIG. 9 shows a perspective view of the container assembly 100.
Figure 10:
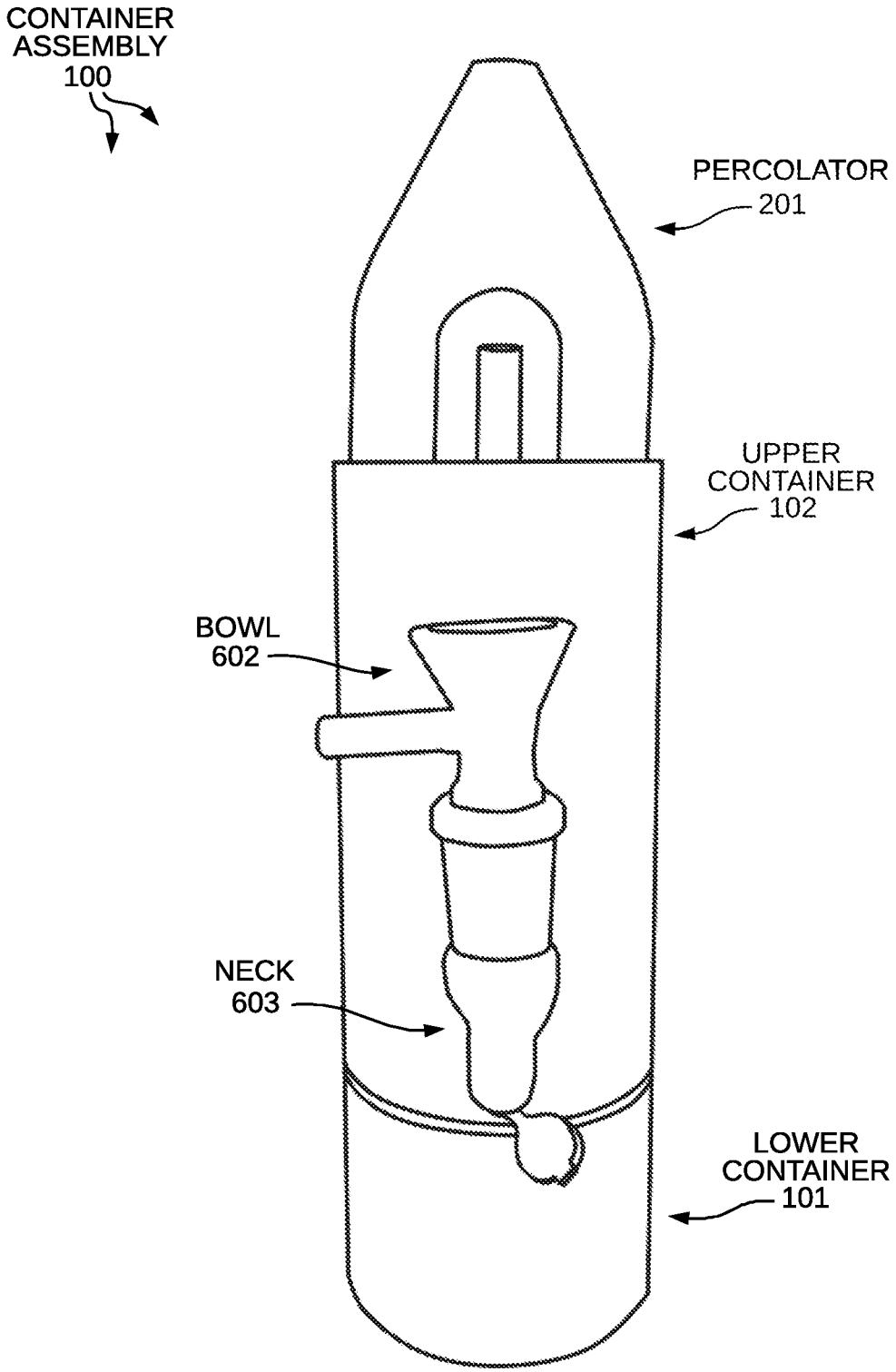
FIG. 10 illustrates a perspective view of the container assembly 100.

FIGS. 9 and 10 show a perspective view of the container assembly 100 wherein the percolator 201 is in an extracted position, the upper container lid 104 is detached from the percolator 201, the neck 603 is attached to the inlet port 103, and the bowl 602 is attached to the neck 603. The container assembly 100 can now be used as a traditional water pipe or bong.

Figure 11:
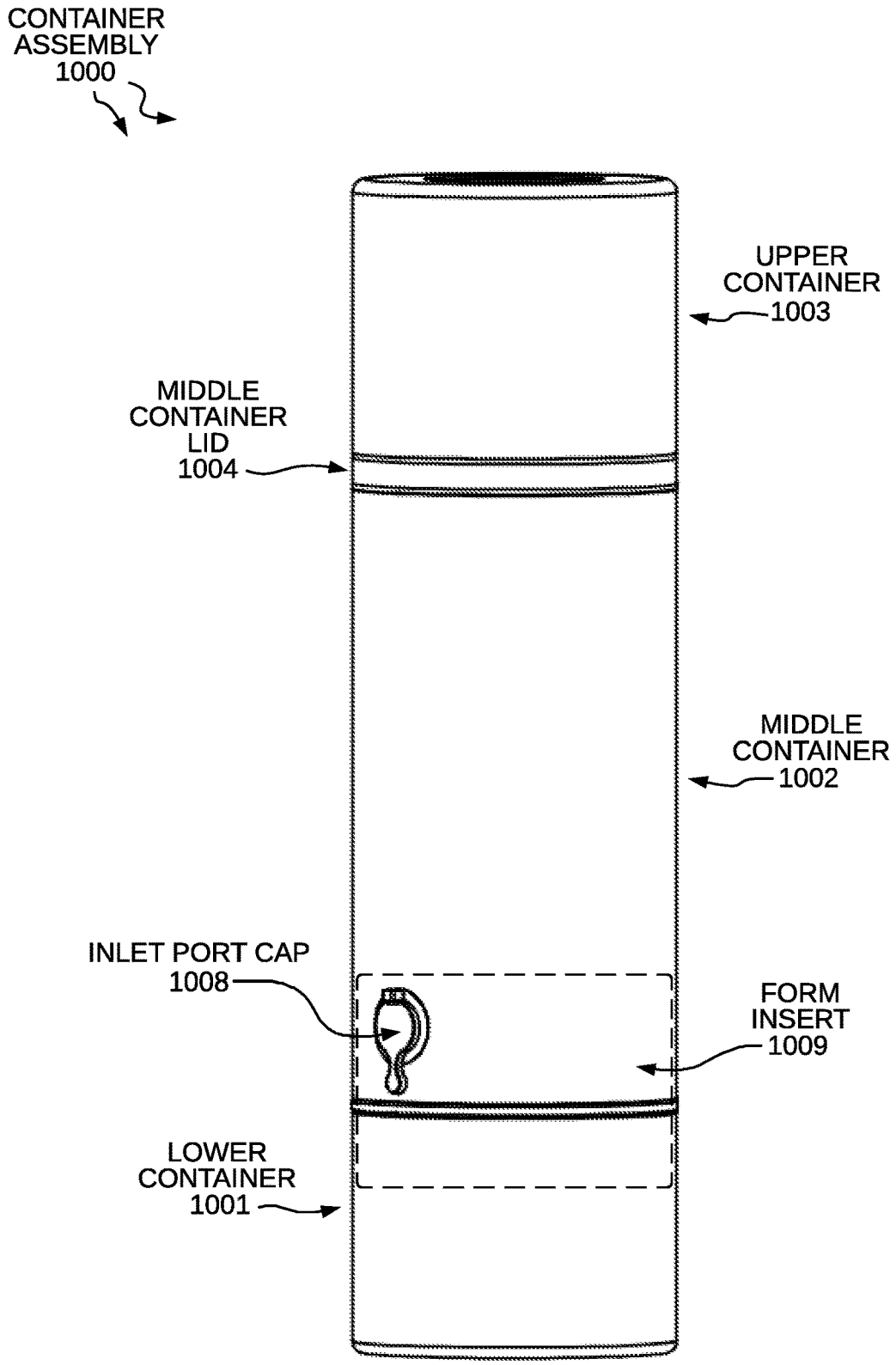
FIG. 11 illustrates a perspective view of another embodiment of an container assembly 1000 configured to store a water bong and water bong accessories.

FIG. 11 is a diagram of a container assembly 1000 in accordance with another embodiment. The container assembly 1000 is comprised of an inner cylinder wall, an outer cylinder wall, an upper container 1003, a middle container 1002 having an inlet port 1005 and inlet port cap 1008, a middle container lid 1004, and a lower container 1001, wherein the upper container 1003, the middle container 1002, and the lower container 1001 are detachably coupled to each other and capable of being segregated from each other. By way of example, one embodiment of the container assembly 1000 is configured to store a water bong or pipe and permits the user to quickly assemble or disassemble the water bong concealed within the upper container 1003, the middle container 1002, and the lower container 1001. A middle container rim is arranged at an upper edge of the middle container 1002. The lower container 1001 comprises a form insert 1009. The form insert is detachably coupled to the lower edge of the middle container 1002, and the lower container is detachably coupled to the form insert.

An upper container 1003 is detachably coupled to the middle container lid 1004. The middle container lid 1004 is detachably coupled to the upper edge of the middle container 1002.

The material of container assembly 1000 is one selected from a group including but not limited to: steel, aluminum, copper, titanium, plastic, or a combination thereof. The preferred material is aluminum because it is the most cost-efficient, easy to clean, and offers protection to the components of the water bong and water bong accessories.

Figure 12:
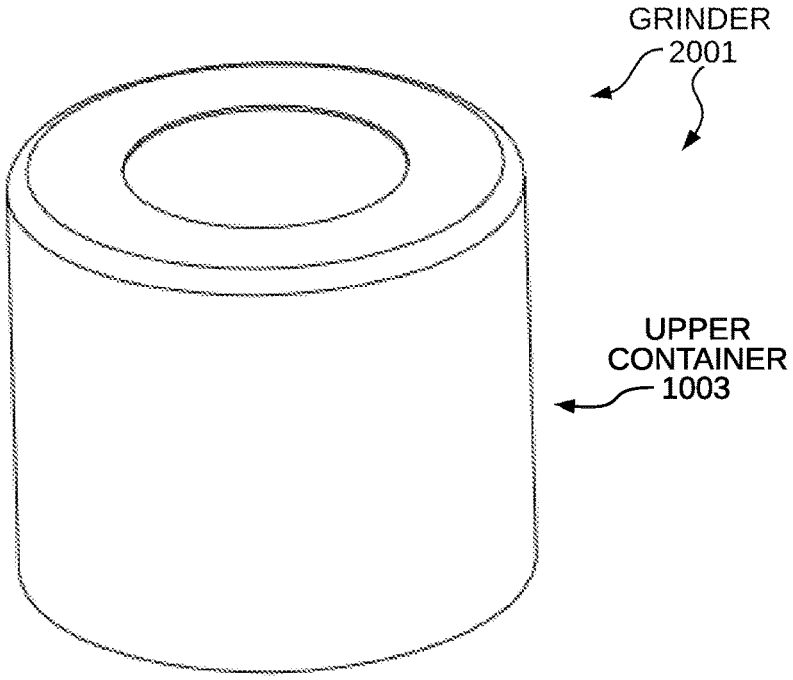
FIG. 12 illustrates a perspective view of a grinder stored in an upper container of the container assembly 1000.
Figure 13:
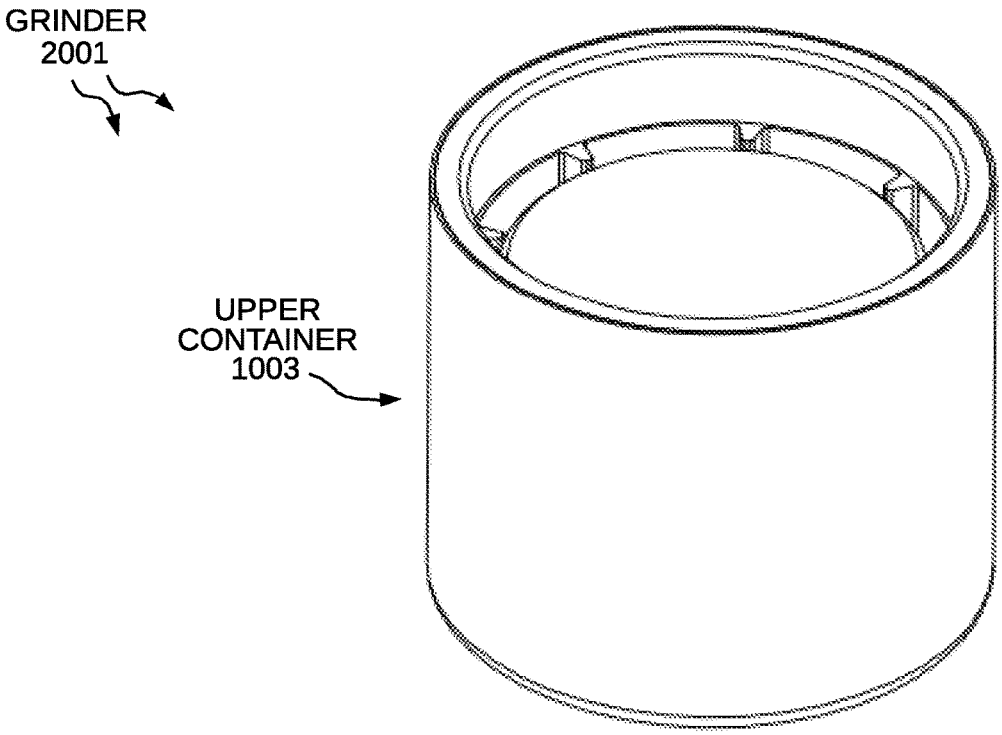
FIG. 13 shows a perspective view of the grinder stored in the upper container of the container assembly 1000.

FIGS. 12 and 13 show a perspective view of the grinder 2001 stored in the upper container 1003 of the container assembly 1000. The upper container 1003 comprises a push release to detach and remove the grinder 2001 from the upper container 1003. Preferably, the grinder 2001 is capable of removing unwanted stems and/or seeds from combustible substances such as tobacco and medicinal herbs.

Figure 14:
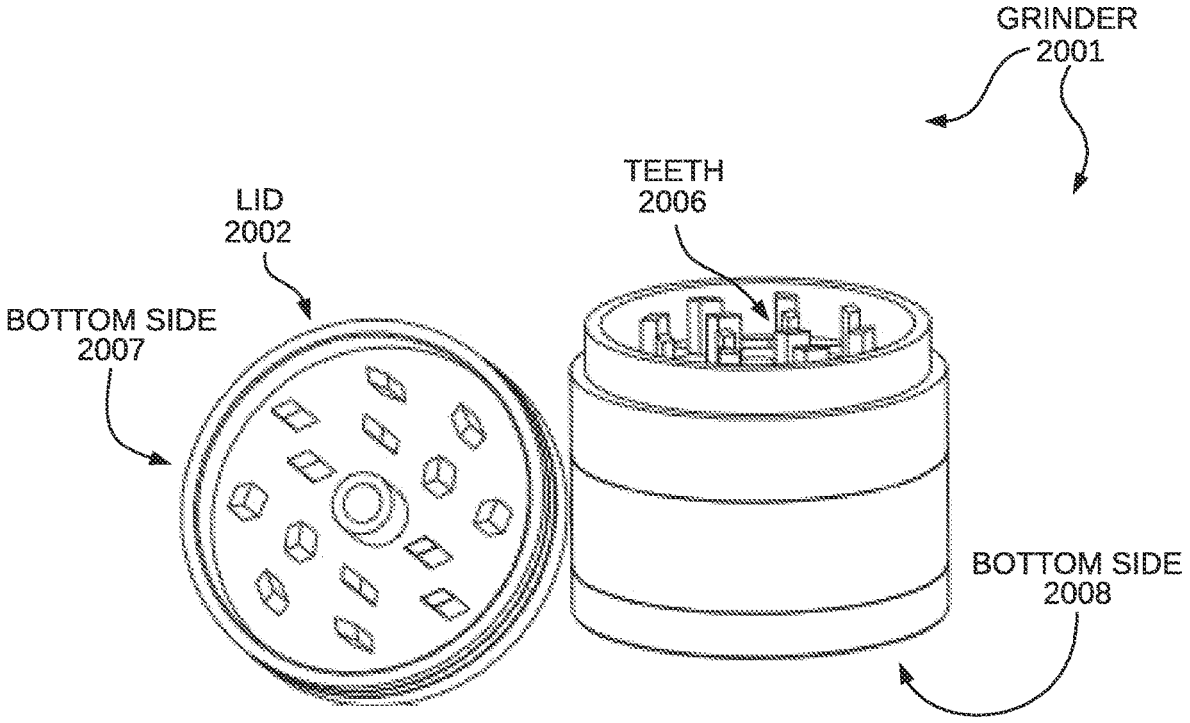
FIG. 14 shows a perspective view of the grinder 2001 of the container assembly 1000.
Figure 15:
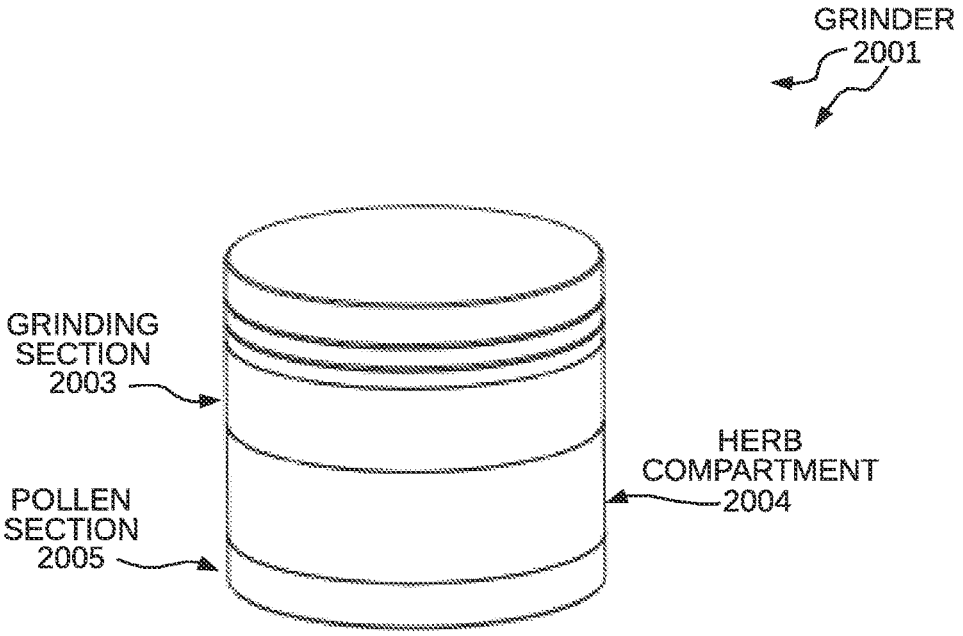
FIG. 15 shows a perspective view of the grinder 2001 of the container assembly 1000.

FIGS. 14 and 15 show a perspective view of the grinder 2001 in one configuration. In one embodiment, the grinder 2001 comprises a lid 2002, a grinding section 2003, which includes a plurality of teeth 2006, wherein the plurality of teeth 2006 are disposed of in a pattern on a bottom side 2007 of the lid 2002 and a bottom side 2008 of the grinding section 2003. In another embodiment, the grinder 2001 includes an herb compartment 2004 to collect the tobacco and/or herb that has been grinded to a finer material. In yet another embodiment, the grinder 2001 comprises a pollen section 2005 which includes a screen to sift the pollen from the tobacco and/or herb. In yet another embodiment, the grinder 2001 is smaller and comprises only a grinding section 2003 to permit the user to store other water bong accessories, such as a lighter, in the upper container 1003.

Figure 16:
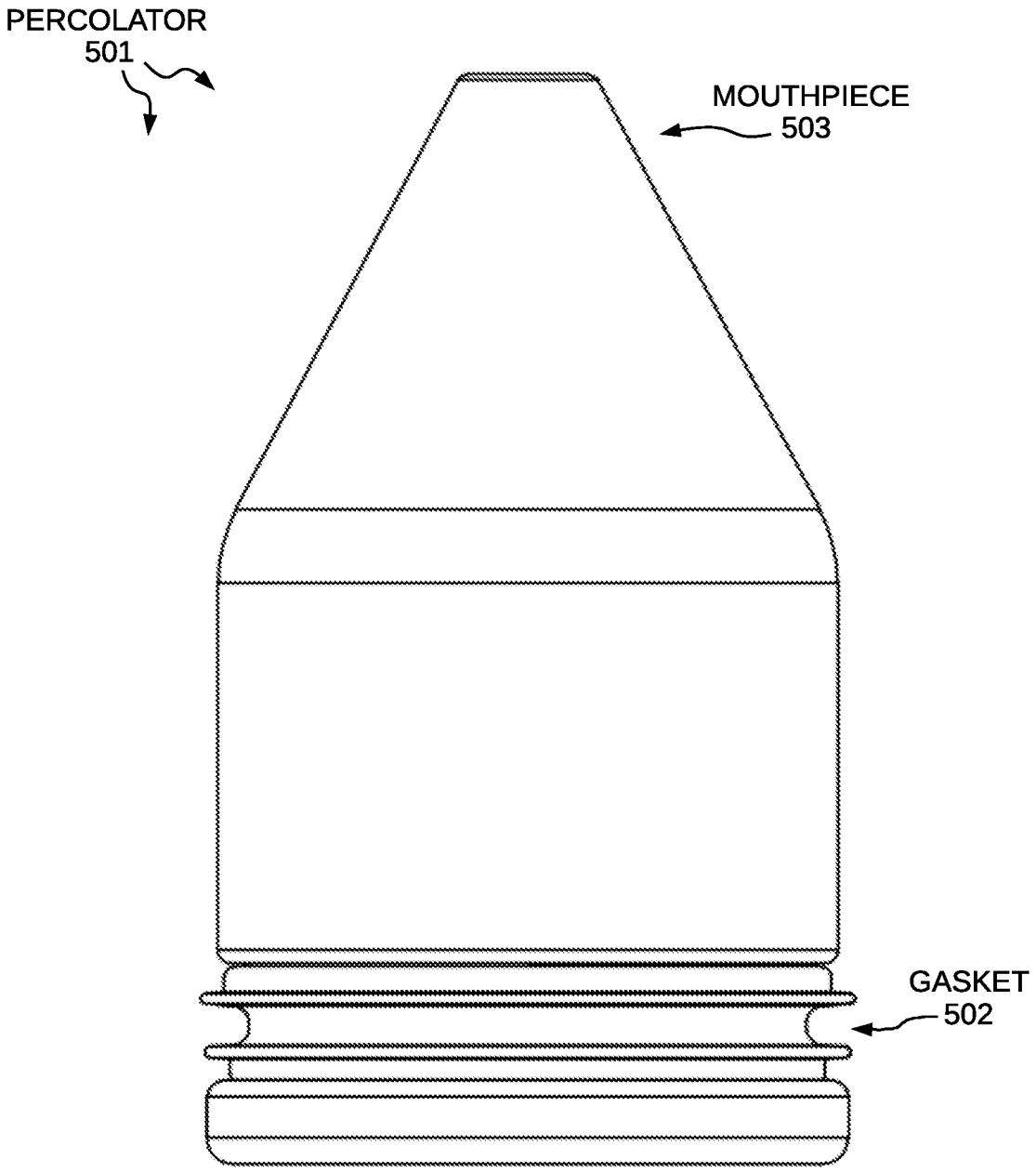
FIG. 16 shows the percolator 501 of the container assembly 1000.
Figure 17:
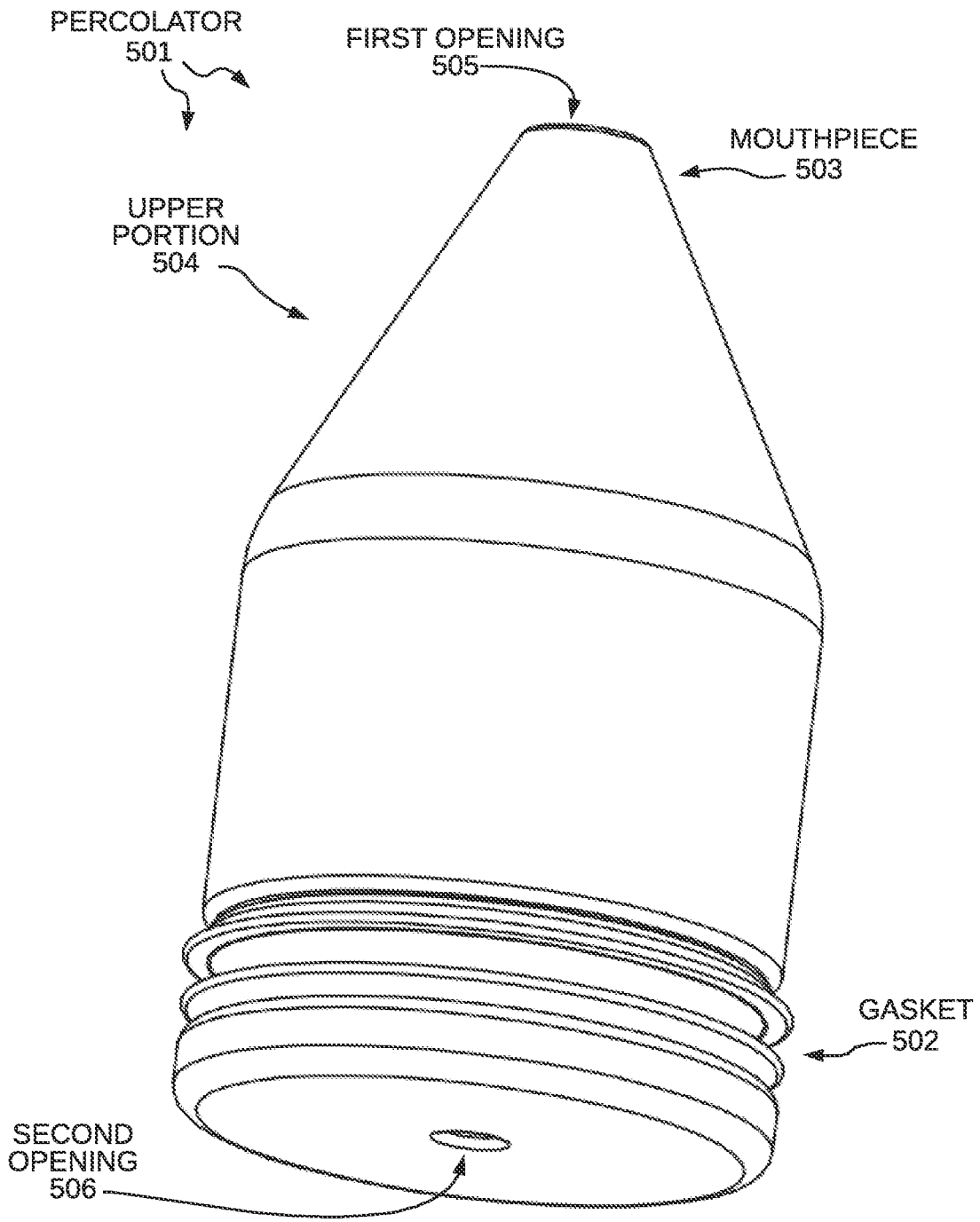
FIG. 17 illustrates a perspective view of the percolator 501 of the container assembly 1000.

FIGS. 16 and 17 show a perspective view of the percolator 501. The percolator 501 comprises a gasket 502 and a mouthpiece 503. The percolator 501 has an upper portion 504 and a first opening 505 opposite the second opening 506. The mouthpiece 503 is arranged at an upper portion 504 of the percolator 501. The percolator 501 is arranged within the middle container 1002 and slides along the inner cylinder wall 1006 to the middle container rim 1007. To access the percolator 501 and extract the mouthpiece 503, a user may simply detach the middle container lid 1004 from the middle container 1002 and pull the middle container lid 1004 upward in a vertical motion from the middle container 1002. When a user pulls the percolator 501 from a concealed position inside of the middle container 1002 to an extracted position, the gasket 502 is pressed against the middle container rim to form a watertight seal. The percolator 501 is one selected from a group including but not limited to: dome, inline, circular, showerhead, honeycomb, tree, matrix, swiss, donut, turbine, or a combination thereof. The preferred percolator 501 is a dome percolator.

Figure 18:
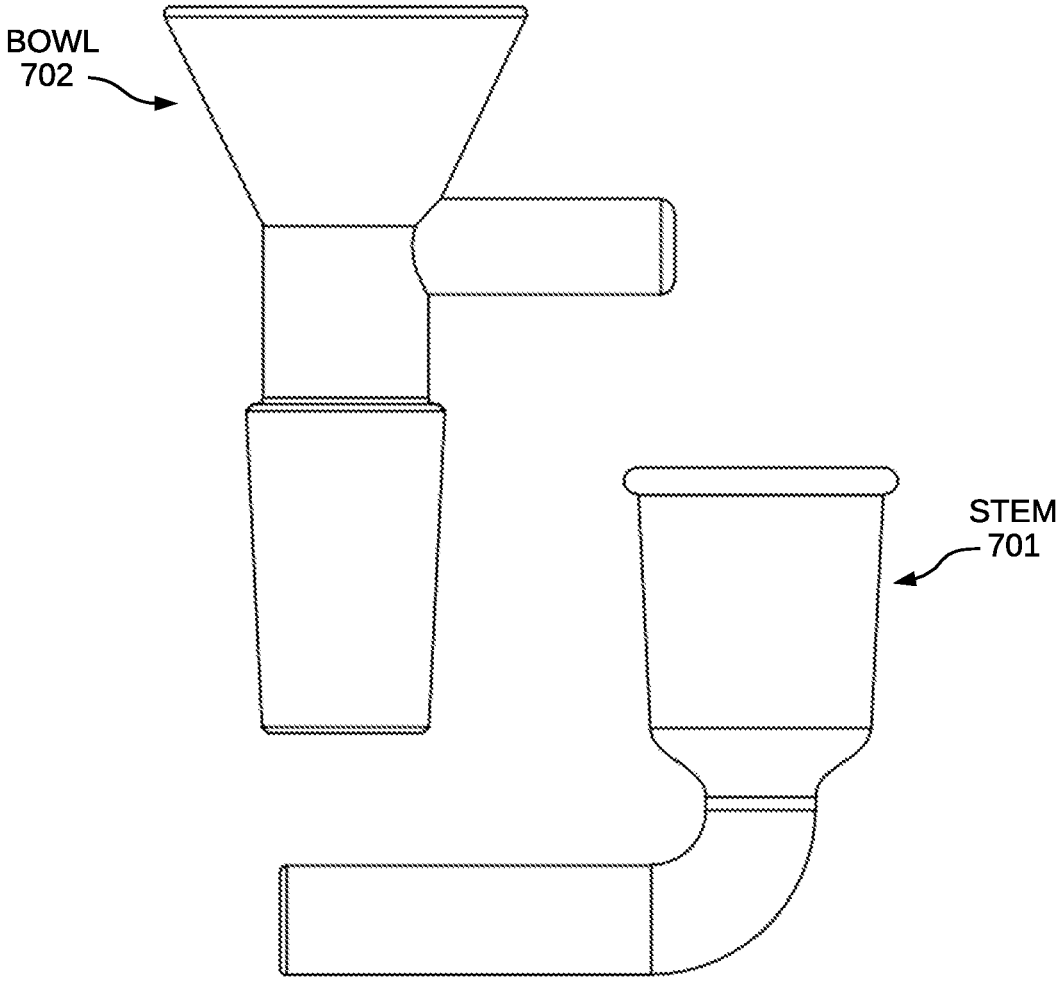
FIG. 18 shows a stem and a bowl the container assembly 1000.

FIG. 18 shows a perspective view of the stem 701 and bowl 702. Stem 701 may also be referred to as a "neck". The stem 701 is in fluid communication with the percolator 501 when a user connects the stem 701 to an inlet port 1005 extending through the outer cylinder wall and inner cylinder wall and into the middle container 1002. The stem 701 may be configured to be stored in the lower container 1001. A user can remove the lower container 1001 and then access the lower container 1001 to remove the stem 701. The bowl 702, when attached to the stem 701, is in fluid communication with the stem 701 and the percolator 501. The bowl 702 may be configured to be stored in the lower container 1001. The stem 701 and bowl 702 are designed from a variety of materials. The preferred material of the stem 701 and bowl 702 is glass.

Figure 19:
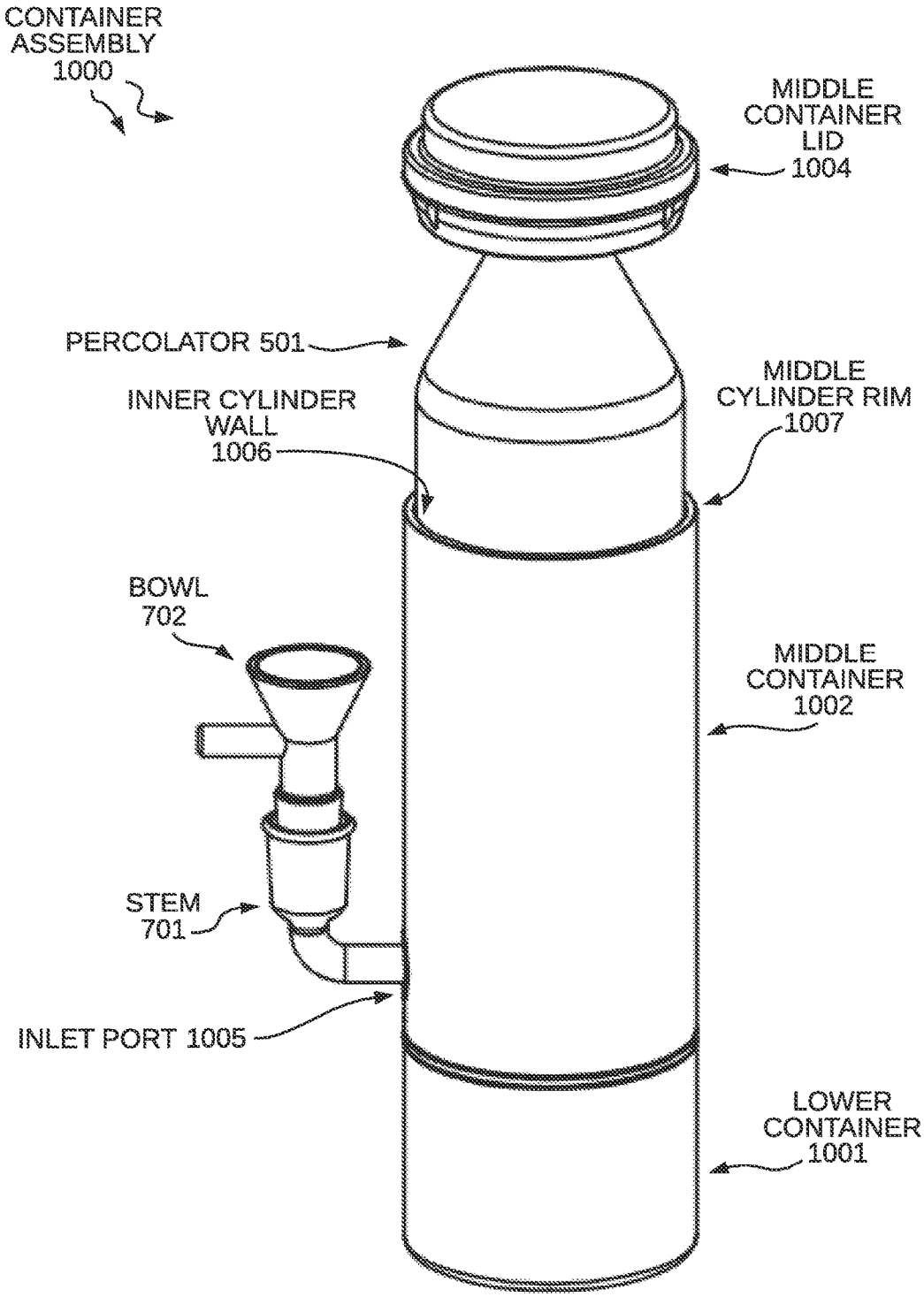
FIG. 19 illustrates a perspective view of the container assembly 1000.

FIG. 19 shows a perspective view of the container assembly 1000 wherein the percolator 501 is in an extracted position and the stem 701 is attached to the inlet port 1005 and bowl 702 is attached to the stem 701. The container assembly 1000 can now be used as a traditional water bong or pipe.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A container assembly comprising:

an upper container;

a middle container, wherein the middle container includes an inner cylinder wall, an outer cylinder wall, an upper edge, a lower edge, a middle container rim arranged at the upper edge of the middle container, and an inlet port, and wherein the inlet port extends through the outer cylinder wall and inner cylinder wall and into the middle container;

a lower container, wherein the lower container is detachably coupled to the lower edge of the middle container;

a percolator, wherein the percolator includes a gasket and a mouthpiece;

a neck, wherein the neck is detachably coupled to the inlet port and is in fluid communication with the percolator through the inlet port, and wherein the neck is configured to be stored in the lower container; and a bowl, wherein the bowl is detachably coupled to the neck and is in fluid communication with the neck and the percolator, and wherein the bowl is configured to be stored in the lower container.

2. The container assembly of claim 1, wherein the percolator is arranged within the middle container and configured to slide along the inner cylinder wall to the middle container rim.

3. The container assembly of claim 2, wherein the gasket is pressed between the percolator and the middle container rim to form a watertight seal.

4. The container assembly of claim 1, wherein the mouthpiece is arranged at an upper portion of the percolator.

5. The container assembly of claim 1, wherein the middle container lid is detachably coupled to the mouthpiece.

6. The container assembly of claim 5, the middle container lid further comprising:

a friction nipple, wherein the friction nipple is detachably coupled to the mouth piece and is configured to be inserted into the mouthpiece of the percolator.

7. The container assembly of claim 1, the inlet port further comprising:

an inlet port cap.

8. The container assembly of claim 1, wherein the lower container is detachably coupled to the lower edge of the middle container via a form insert.

9. The container assembly of claim 8, wherein the form insert is adapted to secure the neck and the bowl when the neck and the bowl are stored in the lower container.

10. A method for disassembling and storing a water pipe in a container assembly, comprising:

attaching a middle container lid of the container assembly to a mouthpiece of the water pipe arranged at an upper portion of a percolator of the water pipe;

applying pressure to the middle container lid to slide the percolator from an extracted position to a concealed position, wherein the percolator is concealed within a middle container of the container assembly;

disconnecting a bowl of the water pipe from a neck of the water pipe;

placing the bowl in a lower container of the container assembly;

disconnecting the neck from an inlet port of the middle container; and placing the neck in the lower container.

11. The method of claim 10, further comprising:

securing the middle container lid to an upper edge of the middle container; and securing the lower container to a lower edge of the middle container.

12. The method of claim 10, wherein attaching the middle container lid to the mouthpiece further comprises inserting a friction nipple into a mouthpiece of the percolator.

13. The method of claim 10, wherein placing the bowl in the lower container further comprises securing the bowl to a form insert, and wherein the form insert is detachably coupled to the middle container.

14. The method of claim 13, wherein placing the neck in the lower container further comprises securing the neck to the form insert.

15. The container assembly of claim 1, further comprising:

a middle container lid, wherein the middle container lid is detachably coupled to the upper edge of the middle container.

16. The container assembly of claim 15, wherein the upper container is detachably coupled to the middle container lid.

17. The container assembly of claim 1, further comprising:

an upper container lid, wherein the upper container lid is detachably coupled to an upper edge of the upper container.

18. The container assembly of claim 1, further comprising:

a grinder, wherein the grinder includes a lid, a grinding section, a plurality of teeth and a bottom side.

* * * * *